United States Patent [19]

Snyder et al.

[11] Patent Number: 4,591,096

[45] Date of Patent: May 27, 1986

[54] CENTRIFUGAL SPRAYER HAVING INTERCHANGEABLE FEED MECHANISM

[75] Inventors: Irving F. Snyder, Blaine; William D. Vork, Edina; Michael Itzin, Brooklyn Park, all of Minn.

[73] Assignee: Polaris Home Systems, Inc., Minneapolis, Minn.

[21] Appl. No.: 565,400

[22] Filed: Dec. 27, 1983

[51] Int. Cl.[4] ..... F23D 11/04; B05B 3/02

[52] U.S. Cl. ..... 239/216; 239/222; 239/223

[58] Field of Search ..... 239/216, 219, 222, 218.5, 239/223

[56] References Cited

U.S. PATENT DOCUMENTS

| | | | |
|---|---|---|---|
| 2,157,416 | 5/1939 | Kjos | 261/91 |
| 2,263,194 | 11/1941 | Shepherd | 261/30 |
| 2,537,833 | 1/1951 | Joos | 239/219 X |
| 2,783,088 | 2/1957 | Butler | 239/215 |
| 2,874,797 | 2/1959 | Flury | 183/18 |
| 3,107,857 | 10/1963 | Flury | 239/216 X |
| 3,110,748 | 11/1963 | Myklebust | 239/216 X |
| 3,151,188 | 9/1964 | Weatherston et al. | 239/216 X |
| 3,181,796 | 5/1965 | Keller | 239/216 |
| 3,220,707 | 11/1965 | Weatherston et al. | 239/216 X |
| 3,267,701 | 8/1966 | Mandarino | 239/215 X |
| 3,455,507 | 7/1969 | Ryder et al. | 239/215 |
| 3,468,614 | 9/1969 | Nilsson | 239/223 X |
| 3,668,996 | 6/1972 | Peiffer et al. | 239/216 X |
| 3,801,016 | 4/1974 | Martin | 239/219 |
| 4,294,408 | 10/1981 | Snyder et al. | 239/218.5 |

FOREIGN PATENT DOCUMENTS

| | | | |
|---|---|---|---|
| 33511 | 4/1964 | Finland | 239/223 |

*Primary Examiner*—Joseph F. Peters, Jr.
*Assistant Examiner*—Kevin Patrick Weldon
*Attorney, Agent, or Firm*—James R. Haller

[57] ABSTRACT

A centrifugal sprayer of the type having an electric motor driving a disc element, and coupled to a feed mechanism, wherein the feed mechanism is suspended in immersion in the liquid to be sprayed, including interchangeable hollow cone feed members having at least several surface slope angles relative to the vertex of the cone, and an outer housing around the feed mechanism, the housing having a bushing surface in supporting contact with the feed mechanism to maintain constant axial position during rotation of the cone feed mechanism.

5 Claims, 5 Drawing Figures

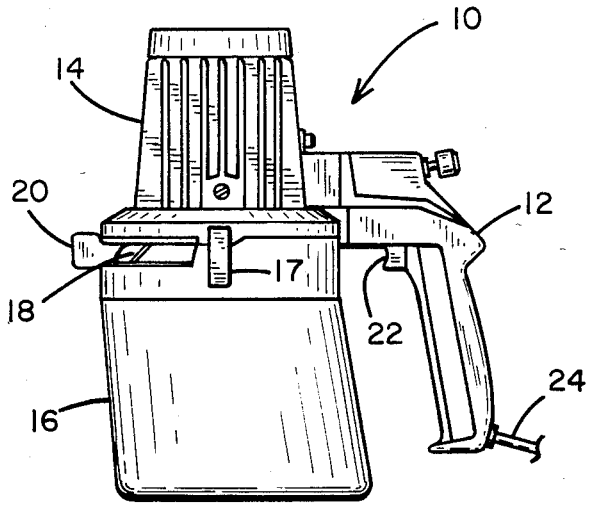
Fig. 1
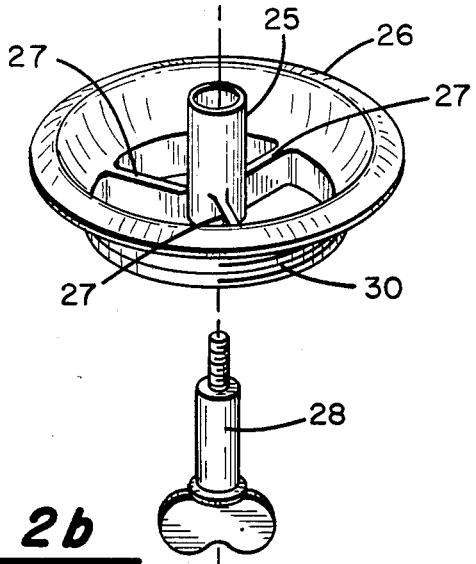
Fig. 2b
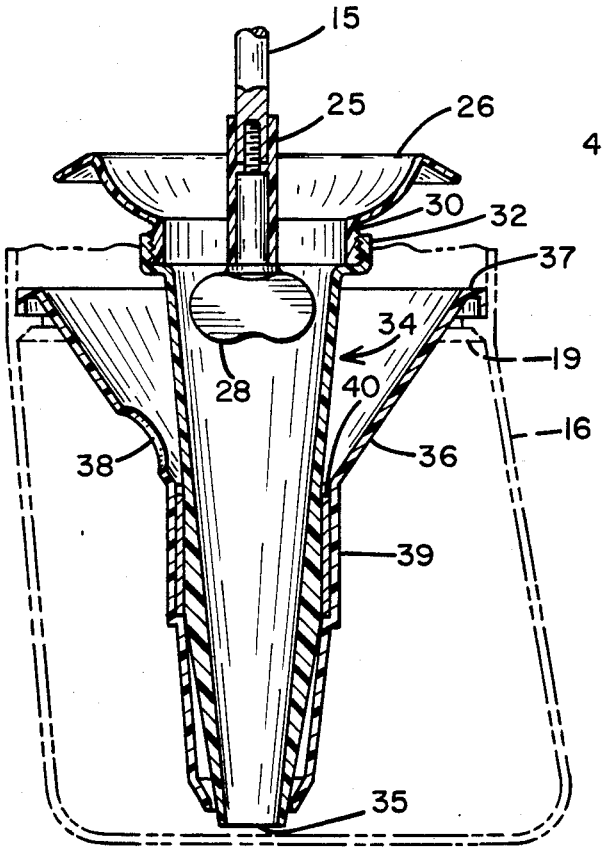
Fig. 2a
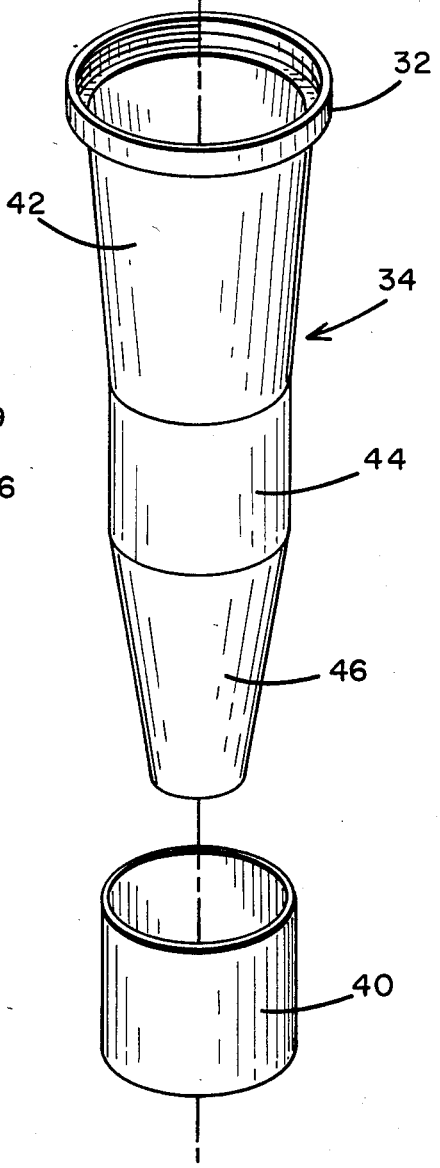

CENTRIFUGAL SPRAYER HAVING INTERCHANGEABLE FEED MECHANISM

BACKGROUND OF THE INVENTION

The present invention relates to centrifugal sprayers, and more particularly to centrifugal sprayers having a motor driven disc element fixedly attached to a liquid feed element, wherein the liquid feed element is attached to the disc and is suspended and immersed into a supply of liquid to be sprayed.

U.S. Pat. No. 4,294,408, issued Oct. 13, 1981, shows a centrifugal sprayer of the type generally related to the present invention. In this type of sprayer a rotating disc is suspended over a supply of liquid to be sprayed, and a feed mechanism is connected to pump liquid up to the spinning surface of the disc where it is centrifugally hurled outwardly in atomized form through a variable gate, to be deposited upon a surface. The aforementioned patent shows a feed mechanism comprising a screw pump, wherein the screw is contained within a tube in immersion in the liquid to be sprayed, and is direct-coupled to the drive mechanism which rotates the disc, so that as the disc is rotated the screw pump also rotates, thereby conveying liquid upwardly and into contact with the spinning surface of the disc. The screw pump mechanism performs adequately for some types of liquids and under certain conditions, but does suffer from a number of disadvantages. Among these disadvantages is the screw, while being immersed in the liquid to be pumped, causes continual agitation of the liquid with resulting aeration of the liquid, which reduces the pumping flow rate of the mechanism. Further, the screw pump is quite difficult to clean, especially when liquids such as paints are being sprayed by the device.

U.S. Pat. No. 3,668,996, issued June 13, 1972, shows a centrifugal atomizer having a rotatable hollow cone immersed in liquid, and connected to a disc for feeding liquid onto the disc for atomization. The cone and disc are formed from a single part, and are attachable to the shaft of a drive motor for uniform rotation. This construction suffers from the disadvantage of being difficult to clean, and from the further disadvantage of rotational instability at high rotational speeds, particularly when high viscosity liquids are sprayed. The cone is supported along an annular line at a point proximate the top of the cone, and high rotational speeds can cause instability of the cone as it is immersed in liquid.

SUMMARY OF THE INVENTION

The present invention includes a centrifugal sprayer having a motor driven disc and cone feed mechanism, wherein at least several different cone angles may be utilized for the feed mechanism in interchangeable relationship. The invention further includes an outer housing which performs the multiple functions of collecting excess liquid and draining it back to the liquid reservoir in which the cone is immersed, preventing the formation of a liquid vortex at the bottom of the cone feed mechanism, and providing a supporting bushing surface for guiding the cone in stable rotational operation. The lower opening of the cone feed mechanism may be selected for providing an inlet for controlling the liquid feed rate into the cone feed mechanism. Provision may be made for providing a bushing intermediate the rotating cone surface and the supporting housing, which prevents wear of the rotating parts and thereby enhances longevity of the mechanism. The disc and outer housing are constructed so as to enable the use of interchangeable cone feed members, wherein different cone angles may be incorporated to better control the pigment separation of different liquids.

It is a principal object of the present invention to provide a rotating cone feed mechanism having the capability of efficiently pumping different liquids.

It is another object of the present invention to provide a rotating cone feed mechanism having a bearing support for guiding the rotating member in stable rotating operation.

It is yet another object of the present invention to provide a centrifugal paint sprayer having interchangeable and readily removable components for rapid disassembly and ease of cleaning of all parts of the sprayer.

The foregoing and other advantages and objects will become apparent from the following specification and claims.

BRIEF DESCRIPTION OF THE DRAWINGS

FIG. 1 shows the invention in elevation view;

FIG. 2*a* shows a partial cross-section view of the invention;

FIG. 2*b* shows one form of interchangeable cone feed mechanism; and

DESCRIPTION OF THE PREFERRED EMBODIMENT

Figure 3B:
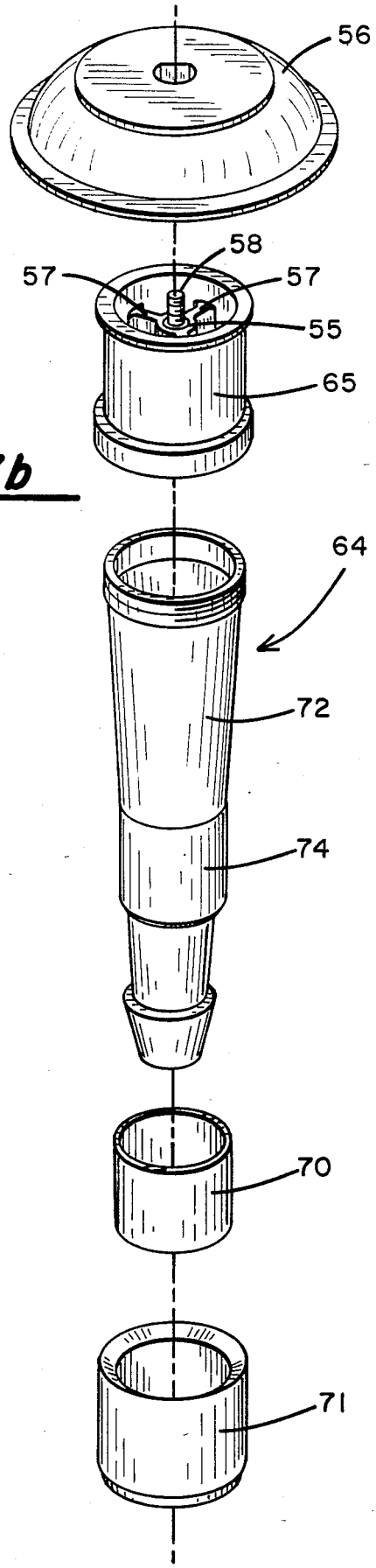
FIG. 3*b* shows a second form of interchangeable cone feed mechanism.

Referring first to FIG. 1 there is shown a sprayer 10 of the type in which the invention is adapted for use. Sprayer 10 has a handle 12 for grasping by an operator, for maneuvering sprayer 10 for purposes of applying coating such as paint on various surfaces. Handle 12 is rigidly attached to a motor housing 14, which housing supports an electric motor therein. The electric motor in housing 14 has its drive shaft 15 (FIG. 2*a*) facing vertically downwardly. A container 16 for containing a supply of paint is removably attached to motor housing 14 by means of one or more attachment clips 17. An opening is formed along the upper edge of container 16, and a slidable gate 20 is movably positioned to vary the size of opening 18. Sprayer 10 is actuable by a trigger 22, which trigger 22 is connected to a switch for coupling electrical power via power cord 24 to drive the motor within housing 14.

FIG. 2*a* shows a cross-sectional view of a portion of the sprayer 10, particularly showing the rotating components which are attached to shaft 15. A disc or cup-shaped member 26 is formed so as to have a central sleeve 25 that is sized for fitting against shaft 15. Sleeve 25 may be threadably attached to shaft 15 by means of fastener 28. Disc 26 has a lower threaded collar portion 30. Collar 30 is threadably secured to a flange 32 which forms an upper part of cone feeder 34. By virtue of these components, rotation of shaft 15 will cause disc 26 and cone feeder 34 to simultaneously rotate therewith. Cone feeder 34 has a bottom opening 35 which is positioned proximate the bottom of container 16. The size of opening 35 may be selected to control the rate of liquid flow into cone feeder 34.

Container 16 has an internal lip 19 extending about its circumference. An outer housing 36 is seated on lip 19 by virtue of shoulder 37, which is formed of a circumference so as to be supported by lip 19. Outer housing 36 is generally funnel-shaped, and has at least one drain opening 38 for permitting the draining of excess paint collected by outer housing 36 back into container 16.

FIG. 2*b* shows an exploded view of several of the components of FIG. 2*a*. Disc 26 has a plurality of support members 27 projecting radially inward and fixedly attached to sleeve 25. Support members 27 provide support and axial alignment of disc 26 about sleeve 25. Cone feeder 34 is formed into at least several different sections. An uppermost section comprises threaded flange 32, for attachment to threaded collar 30 on disc 26. Next, a hollow conical section 42 depends downwardly from flange 32 for a predetermined distance. Cone section 42 is adjacent to a tubular section 44 which is sized for fitting inside of a corresponding tubular section 39 formed on outer housing 36. Tubular section 44 is joined to a further cone section 46. A metallic or other material bushing 40 may be provided, so as to slidably fit over tubular section 44, and within tubular section 39 of outer housing 36. Bushing 40 serves to provide a relatively frictionless surface for rotating contact of the respective members. Alternatively, tubular section 44 may be constructed of a diameter so as to fit within tubular section 39 without the addition of bushing 40, in the event the materials of the respective components are finished sufficiently to provide relatively free rotation therebetween.

Figure 3A:
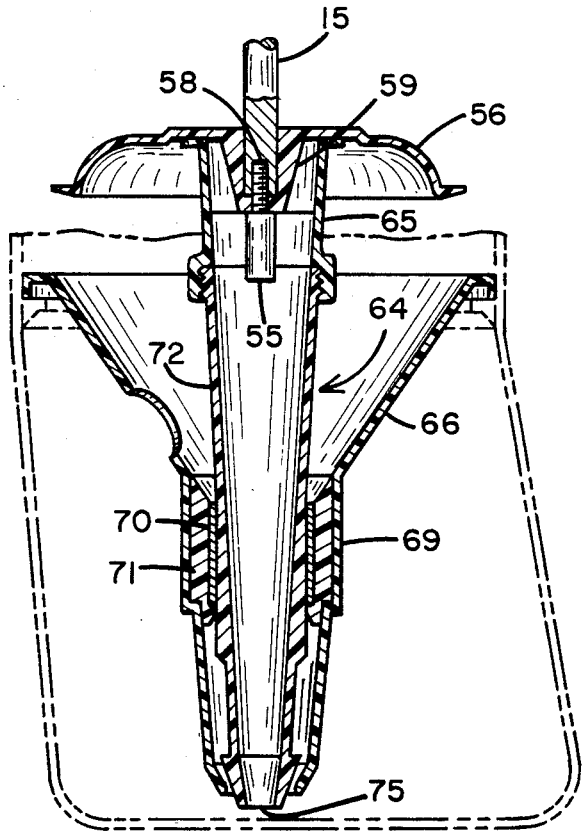
FIG. 3*a* shows a partial cross-section view of the invention.

FIG. 3*a* shows a further embodiment of the invention in partial cross-sectional view. Motor shaft 15 is fixedly attached to a sleeve 55 by means of a fastener 58, fastener 58 being frictionally engageable within sleeve 55 so as to prevent rotation therebetween. Disc 56 is clamped between sleeve 55 and motor shaft 15 by virtue of hub 59 which fits over the end of shaft 15. Sleeve 55 is rigidly attached to an upper section 65 of cone feeder 64 by means of a plurality of supports 57 (see FIG. 3*b*). Upper section 65 is threadably attached to a further cone section 72. Cone section 72 extends downwardly and is axially seated within outer housing 66 for free rotation therewithin. Cone section 72 has an outer cylindrical surface section 74, surface section 74 being postioned so as to fit inside of a corresponding tubular section 69 on outer housing 66. Liquid feed opening 75 may be constructed of any preferred diameter to properly control the flow rate of liquid to the inside of cone section 72.

A number of different constructions may be utilized to provide the necessary fit between cylindrical surface section 74 and tubular section 69. A spacer member 71 may be sized for snugly fitting inside of tubular section 69, and a metallic bushing 70 may be sized for fitting between the inside surface of spacer member 71 and the outside surface of cylindrical surface section 74. In this case, the respective components are sized to provide free rotation of cone feeder 64 within metallic bushing 70. Alternatively, the outer surface diameter of cylindrical surface section 74 may be increased, or the inner surface diameter of tubular section 69 may be correspondingly decreased, so as to provide a mating bushing surface capable of free rotation therebetween. The important consideration with respect to these members is that an axially extending bushing surface be provided between cone feeder 64 and outer housing 66.

In operation, all of the embodiments described herein operate by virtue of attachment to the motor shaft, rotation of the motor shaft causing corresponding rotation of the members connected thereto. In the embodiment shown in FIGS. 2*a* and 2*b* the cone feeder is immersed in a supply of liquid within container 16, and the spinning motion of the cone feeder causes the liquid trapped inside of the cone feeder to become centrifugally captured by the interior wall surface of the cone feeder. The tapered cone section of this internal wall surface causes the liquid therein to rise vertically within the cone feeder and ultimately to become deposited on the upper surface of the disc. The liquid which is fed to the disc surface in this manner is centrifugally hurled outwardly in atomized form by the spinning disc, against the inside surface of the upper portion of container 16. The opening 18 provided therein permits a portion of this liquid to escape from container 16, in the form of fine atomized droplets, and this escaping material is applied as a coating to a surface. The adjustable gate permits selective variation of the amount of material which is permitted to escape, and thereby provides a control over the pattern width of the sprayed paint. The remaining paint which is hurled from the spinning disc is collected along the inner surface of the upper section of container 16, and drains downwardly over the inside surface of outer housing 36 and back into container 16. One or more openings are provided in outer housing 36 to permit the rapid draining of this excess accumulated paint. Some of the paint flowing down the inside surface of the outer housing flows between the outer housing and the cone feeder, thereby to serve as a lubricating film to ensure smooth rotation therebetween.

In the embodiment shown in FIGS. 3*a* and 3*b* the essential operating features remain the same. However, in this embodiment the cone feeder feeds the liquid upwardly to the undersurface of the spinning disc, by virtue of an annular opening between the upper edge of the cone feeder and the lower surface of the disc. The liquid which escapes through this annular opening is centrifugally hurled outwardly in the same manner as described hereinbefore, and the excess liquid accumulates and runs down the inside surface of the outer housing as described above. In either embodiment, there is an upwardly propelling force upon the liquid trapped inside of the cone feeder, which force causes this liquid to rise and be metered onto the spinning disc surface. In the case of the first embodiment, by virtue of the larger cone angle of the portion of the cone feeder immersed in the liquid, it is better adapted for reducing pigment separation of certain paints. Therefore, this embodiment is adapted for spraying lower viscosity coating material. Conversely, the narrower cone angle selected for the second embodiment is more adaptable for use with higher viscosity liquids. By properly selecting the respective cone angles for either embodiment, it is possible to achieve any practical liquid feed rate with liquids of varying viscosity.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A centrifugal sprayer of the type having a disc member attached to a rotatable drive member proximate the top of a liquid container which is itself attachable to a housing enclosing the rotatable drive member, comprising (a) A hollow cone member attached to said disc and to said rotatable drive member, said cone member having an opening proximate the bottom of said container;

(b) A funnel-shaped housing supported inside said container and having a portion thereof encircling said cone member;

(c) Said cone member and housing having, respectively, first and second tubular sections, and a bushing sleeve fitted between said tubular sections and sized to permit free rotation of the cone within the housing and to guide the cone in stable rotational operation within the housing.

2. The apparatus of claim 1 wherein said hollow cone member further comprises a first conical section of first predetermined cone angle attached to said disc and said rotatable drive member, and a second lower conical section of a second predetermined greater cone angle.

3. The apparatus of claim 2, wherein said first and second conical sections are joined to.

4. A centrifugal sprayer of the type having a disc member attached to a rotatable drive member proximate the top of a liquid container which is itself attachable to a housing enclosing the rotatable drive member, comprising (a) a hollow cone member attached to said disc and to said rotatable drive member, said cone member having an opening proximate the bottom of said container and having a first tubular section; said disc member having a threaded collar and said cone member having a mating threaded flange engaging the threaded collar;

(b) a funnel-shaped housing supported inside said container and having a portion thereof encircling said cone member and providing a second tubular section facing the first tubular section and positioned to guide the cone in stable rotational operation; and (c) the first and second tubular sections having fitted therebetween a bushing sleeve, and being sized to permit free rotation therebetween.

5. The apparatus of claim 4, wherein said cone member further comprises an upper edge spaced from said disc.

* * * * *